United States Patent [19]

Brown

[11] Patent Number: 4,751,506

[45] Date of Patent: Jun. 14, 1988

[54] SCOREBOARD DEVICE

[76] Inventor: Colin T. Brown, The Old Post Cottage, Snetterton, Norfork, England

[21] Appl. No.: 533,798

[22] Filed: Sep. 19, 1983

[30] Foreign Application Priority Data

Sep. 18, 1982 [GB] United Kingdom ..... 8226646

[51] Int. Cl.[4] ..... G09G 3/34

[52] U.S. Cl. ..... 340/718; 340/756; 340/762; 273/1 ES

[58] Field of Search ..... 340/702, 718, 782, 703, 340/784, 762, 756, 815.2, 815.04, 753, 754, 323 R, 715; 40/541; 273/1 ES

[56] References Cited

U.S. PATENT DOCUMENTS

| | | | |
|---|---|---|---|
| 3,710,379 | 1/1973 | Bruinsma | 340/702 |
| 3,924,227 | 12/1975 | Stolov | 340/702 |
| 3,981,002 | 9/1976 | Gardner | 340/324 R |
| 4,009,566 | 3/1977 | Ho | 340/762 X |
| 4,045,788 | 8/1977 | Castelli et al. | 340/324 R |
| 4,263,736 | 4/1981 | Beierwaltes et al. | 340/756 X |
| 4,268,826 | 5/1981 | Scott et al. | 340/782 X |
| 4,271,408 | 6/1981 | Teshima et al. | 340/702 |
| 4,286,263 | 8/1981 | Lindberg | 340/718 X |
| 4,286,323 | 8/1981 | Meday | 340/324 R |
| 4,298,869 | 11/1981 | Okuno | 340/782 |
| 4,301,450 | 11/1981 | Smoliar . | |
| 4,321,598 | 3/1982 | Warner | 340/782 |
| 4,323,895 | 4/1982 | Coste | 340/782 |
| 4,334,220 | 6/1982 | Suzuki et al. | 340/782 X |
| 4,367,467 | 1/1983 | Emile, Jr. | 340/718 X |
| 4,367,471 | 1/1983 | Gillessen | 340/782 X |
| 4,417,240 | 11/1983 | Ahmed | 340/782 |
| 4,445,132 | 4/1984 | Ichikawa et al. | 340/782 X |
| 4,454,596 | 6/1984 | Wunsch et al. | 340/718 X |
| 4,482,894 | 11/1984 | Matsui et al. | 340/762 X |
| 4,488,149 | 12/1984 | Givens, Jr. . | |
| 4,506,261 | 3/1985 | Lawter | 340/718 |

*Primary Examiner*—Marshall M. Curtis
*Assistant Examiner*—Mahmoud Fatahi-Yar
*Attorney, Agent, or Firm*—Penrose Lucus Albright

[57] ABSTRACT

A display device for displaying numerical results of athletics and/or games and the like formed from a rear support panel attached to a front cover of colored transparent sheet material by a surrounding frame forming a shallow box. The transparent sheet material is removable by sliding from the overall unit to reveal the printed circuit boards laid out there below.

Within the box printed circuit boards are removably secured each having mounted thereon a plurality of light emitting diodes arranged in the form of a bisected parallelogram so that by selectively energizing groups of the light emitting diodes, different sections of the bisected parallelogram can be illuminated to display different numerals in the range 0 to 9.

A control unit is connected to the display unit having switching devices which can be set to cause different patterns of light emitting diodes to become illuminated.

The light emitting diodes making up each straight line segment of the bisected rectangle are arranged in two parallel lines and the power to each line is independent of the other, and the light emitting diodes in each line are interconnected in series so as to reduce current demand.

23 Claims, 3 Drawing Sheets

SCOREBOARD DEVICE

DESCRIPTION

FIELD OF INVENTION

This invention concerns display units and particularly scoreboards and the like which can be used in gymnasiums and on playing fields and in athletics and games stadiums.

BACKGROUND OF THE INVENTION

It is known to provide illuminated displays to indicate the score and other outcomes of athletic results and/or the outcome of games such as football, basketball and the like. Typically such scoreboards in the past have comprised a large number of incandescent filament lamps ranged in patterns with selective switching to allow different numbers to be displayed by appropriate illumination of numbers of the lamps.

Such displays require considerable electrical power to provide the current for operating the electric lamps and the problem of local heating within such display units has been considerable.

In addition the reliability of incandescent lamps has tended to mean that such display units have not proved entirely reliable in practice and as bulbs have failed to gaps have been left in the display so that the numerals or other indicia in the display have appeared incomplete.

It is an object of the present invention to provide an improved display which does not suffer from these disadvantages and which allows for replacement in the event of lamp failure.

SUMMARY OF THE INVENTION

According to the present invention a display device for displaying inter ali numerical results of athletics and/or games and the like comprises:

1. A rear support panel
2. A front cover of colored transparent sheet material
3. A surrounding frame for supporting the transparent sheet material relative to the rear support panel and forming a shallow box
4. A plurality of printed circuit boards removably located within the shallow box, each circuit board having mounted thereon a plurality of light emitting diode devices arranged in the form of a bisected parallelogram so that by selectively energizing groups of the light emitting diodes, different sections of the bisected rectangle can be illuminated to display different numerals in the range zero to nine.
5. A control unit connected to the display unit having switching devices which can be set to cause appropriate patterns of light emitting diodes to become illuminated to display different numerals in the display
6. Wherein (a) the light emitting diodes making up each straight line segment of the bisected rectangle are arranged in two parallel lines.

(b) power to each line is independent of the other, and (c) the light emitting diodes in each said line are interconnected in series so as to reduce current demand.

The invention allows for replacement in the event of lamp failure in that each printed circuit board can be readily clipped in or out and by using appropriate edge connectors and the like, no flying lead connections are required and the mere positioning of a printed circuit board into place or removal of same will automatically make or break the requisite electrical connections.

By connecting the light emitting diodes in series so the current requirements for the printed circuit boards can be reduced quite significantly.

By providing independent electrical current to the two lines of light emitting diodes making up each straight line segment of each bisected rectangular array of lamps, failure of a lamp in one line will not cause the other line necessarily to become extinguished and the illuminated outline of the numeral will still be seen although one of the straight line segments will have only one half of the illuminated width of the other remaining segments. Observation of the display device will indicate any such failed lines of light emitting diodes and at the next available opportunity the offending board can then be replaced.

This form of replacement upon failure can be performed even by a relatively unskilled person once they have been shown how to clip a board in place and this features is of considerable importance bearing in mind that stadiums and sports grounds and the like do not normally include skilled electronics engineers on their staff.

According to a preferred feature of the invention, the transparent sheet material is conveniently removable by sliding from the overall unit to reveal the printed circuit boards layed out therebelow. Typically the front cover can be slid either to the left or to the right depending on which half of the array contains the defunct printed circuit board.

According to a further preferred feature of the invention, the display unit includes at least one array of printed circuit board for displaying numerals which can be controlled by electrical signals derived from a clock generator in the control unit so as to produce a rising or falling numerical value corresponding to the time which has accumulated or lapsed depending on the activity.

Where decimal points or full stops or other similar so-called punctuation marks are required in the display, dedicated displays are preferably provided for such devices in the form of reduced sized printed circuit boards containing an appropriate array of light emitting diodes to produce an illuminated indication of the punctuation mark. Where a line is to be so reproduced, in accordance with the invention, at least two lines of light emitting diodes are provided in parallel, each independently supplied with electrical power so that failure of one line or of one lamp in one line will not result in a total failure of that part of the display.

Where a full stop or dot or the like is to be designated, preferably at least two and preferably four lamps are arranged again either as two separate lamps or two pairs of lamps so that failure of one lamp or one pair will not totally impair the display.

According to another feature of the invention, the control switches in the control unit by which different illuminated numbers can appear in the display conveniently comprise rotary switches each of which containes a plurality of rotatable elements each of which contains around its periphery the numbers zero to nine and each rotatable member can be rotated through a series of so-called "click stop" positions, the number appearing in a window at the front of the switch corresponding to the number which will appear in the display.

Such switches, commonly known as digiswitches, are known and automatically generate electrical control signals when rotated into selected positions corresponding to the different numbers so as to produce in a display the appropriate illumination of different segments of a bisected rectangle so as to produce illuminated numbers in the display. By decoding the outputs from such switches and producing appropriate control signals for the different lines of light emitting diodes, so a reliable and functional display panel can be produced.

Preferably the control unit, previously mentioned, includes within it a clock generator circuit for producing accurate one second or tenth of second pulses and means is provided for decoding the pulses to provide either an increasing or decreasing digital signal for display as an ascending or decending numerical value corresponding to time.

Preferably means are provided for re-setting the numerical clock value to zero or to a preset number at the beginning of an event.

Preferably the control unit includes a switch which reduces the EMF or current to the light emitting diodes so as to control the brightness of the display.

According to another feature of the invention, the control unit preferably includes switch means for turning on or off the display of the score or outcome of the event, and means for switching on and off the display of the numerical value associated with time.

Where a horn is to be incorporated or a bell is to be incorporated, control switches are conveniently provided in the control unit for controlling the horn and or the bell.

Where a display unit is to be used to record the score of a game such as basketball, additional dedicated functions are conveniently provided in the control unit and appropriate printed circuit boards bearing appropriate light emitting diode displays are located within the display so that for example, time out and eight fouls can be indicated during the progress of the game.

The invention will now be described by way of example with reference to the accompanying drawings in which:

DESCRIPTION OF THE PREFERRED EMBODIMENT

Figure 1:
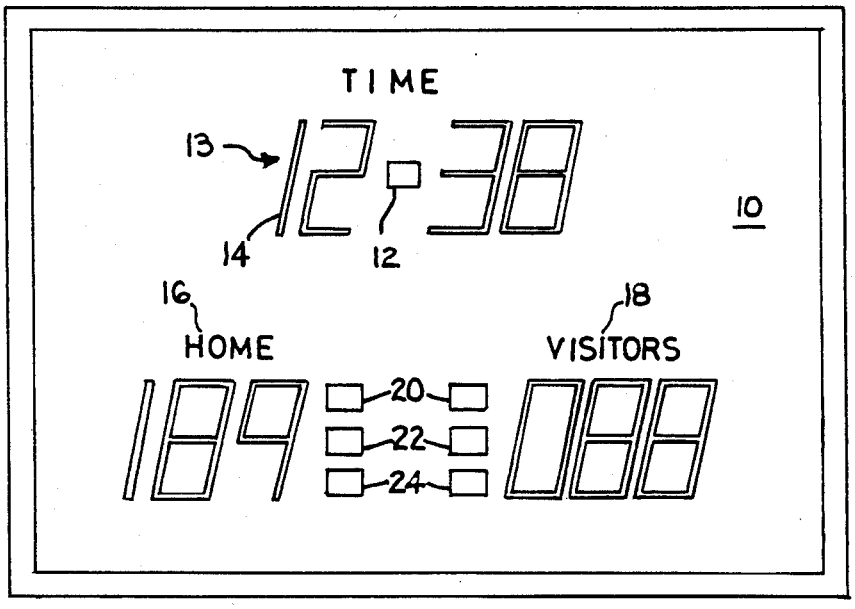
FIG. 1 is a front elevation of a scoreboard embodying the invention.

In FIG. 1 the scoreboard 10 includes a first display in the top half in which up to four digits can be displayed complete with a full stop such as 12, the digits being designated for example by reference numeral 14, so as to indicate a time. This can either be an increasing or a decreasing value and is controlled by a master clock circuit in a control unit (see FIG. 7). The board is connected to the control unit by a flying lead or the like (not shown).

In addition, displays in the lower part of the scoreboard are provided for indicating the numerical value of the score of a home team and of a visitors team.

The two displays are designated "HOME" and "VISITORS" at 16 and 18.

Where the scoreboard is for use with a game of basketball, three further indicators at 20,22 and 24 are provided each identified by a letter T1,T2 or 8F indicating time out for one team, time out for the other team and eight fouls.

Figure 2:
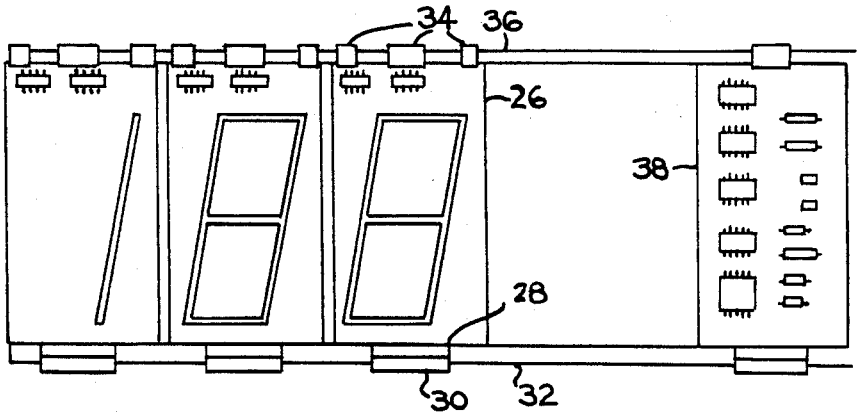
FIG. 2 illustrates part of the interior of the scoreboard in FIG. 1 and illustrates how printed circuit boards can be mounted behind the front panel so as to be capable of being removed for replacement.

As shown in FIG. 2, each of the numerals in the display is formed by illuminating different straight line segments of a bisected rectilinear outline which may be in the form of a rectangle or a parallelogram, the latter being preferred in practice. The different straight line segments are made up of pairs of lines of light emitting diodes and reference is made to FIG. 3 for detail of how the light emitting diodes are actually mounted and arranged.

As shown in FIG. 2, each rectangular or parallelogram array is carried by a printed circuit board such as 26 and the latter includes an edge connector 28 for connecting to a mating unit 30 attached to support bar 32 and is held in position by a snap action clips 34 on the opposite edge of the board, the clips 34 being attached to a second rigid bar 36.

Power supplies for the boards are provided from one or more control boards such as 38 which is conveniently mounted in a similar manner to the other board at one end or the other or both of the rails 36 and 32.

Figure 3:
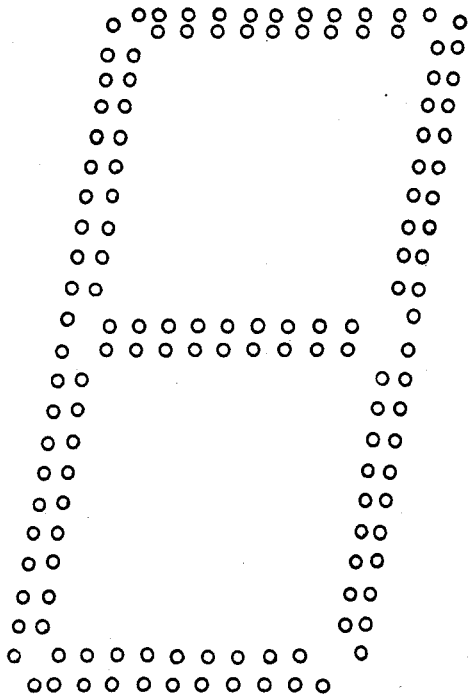
FIG. 3 is a view to an enlarged scale of the layout of the light emitting diodes on one of the printed circuit boards.
Figure 6:
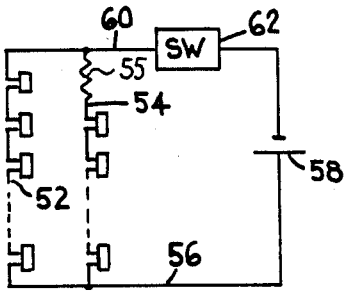
FIG. 6 is a simplified circuit diagram showing how the two lines of light emitting diodes making up each segment of each part of the display of each numeral are connected in series.

As shown in FIG. 3, each straight line segment of the bisected parallelogram is made up of eleven outer and nine inner light emitting diodes. As shown in FIG. 6, the outer line of eleven diodes are connected in series as one element and the nine inner diodes of each pair of lines is likewise connected in series as a second element. Each of the elements is supplied independently with electrical power so that if one of the diodes failed and one of the lines fails to operate so that overall outline is not destroyed since the other parallel line will still remain illuminated.

A quick check of a scoreboard will quickly reveal whether any of the pairs of lines are incorrectly operating and if so replacement of the offending board is a simple matter of removing the offending board and plugging in a new board.

Figure 4:
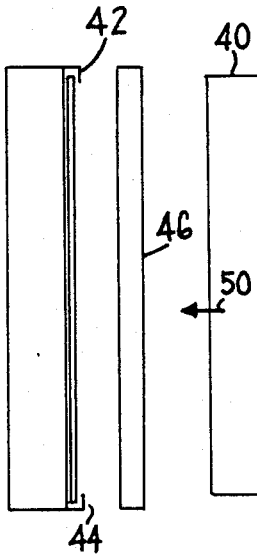
FIG. 4 and FIG. 5 illustrate how the front panel can be removed by sliding from the overall assembly to give access to the printed circuit boards therebehind.
Figure 5:
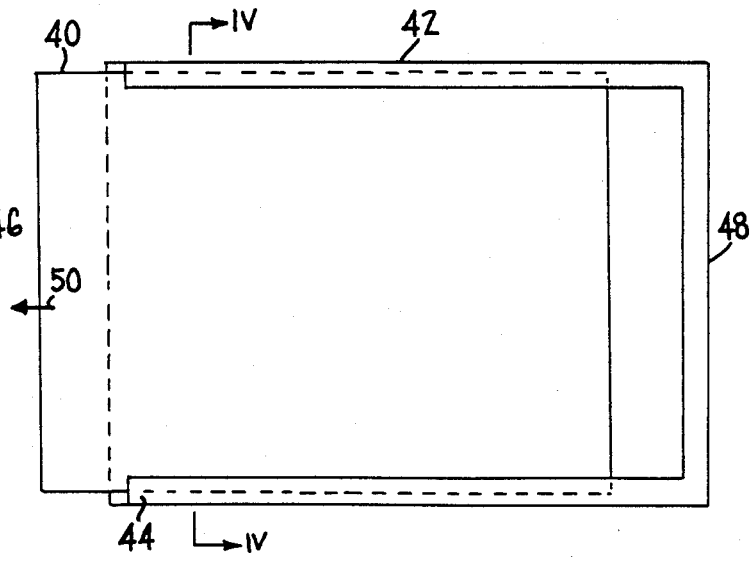

FIG. 4 and FIG. 5 illustrate how the front panel designated by reference numeral 40 can be removed from one or other end of the assembly 10. To this end the upper and lower front edges of the shallow box making up the display unit 10 are formed with channels at 42 and 44, see FIG. 4 inparticular, in which the front panel 40 is a close sliding fit.

End channel members 46 and 48 are provided which are securable by means of screws (not shown) to the walls of the shallow box-like structure 10 to overlap and seal and hold in place the front panel 40.

By removing the screws holding one or other of the ends 46 and 48, so the front panel 40 can be slid in either the direction shown by the arrow 50 (in the case of element 46 being removed) or in the opposite direction in the event that channel section 48 is removed.

FIG. 6 shows how two lines of light emitting diodes connected in series can be supplied from a single source independently through a single switching circuit. To this end two lines of light emitting diodes are designated by reference numerals 52 and 54 respectively and are shown connected to a common bus-bar 56 to one side of a d.c. source 58. The other ends of each series connected chain are connected to a second bus-bar 60 which is connected through a switching unit 62 to the other side of the source 58.

Where a different number of light emitting diodes are provided in one of the chains such as 52 from the other such as 54, a current limiting resistor or the like 55, of known type, is provided in the chain containing the smaller number of light emitting diodes so as to reduce the current which would otherwise flow through the diodes to a correct value.

It will be seen that if one of the light emitting diodes in either of the chains fails and goes open circuit, (the normal failure of a diode junction of this type) the remaining line of diodes will be unaffected and will shine just as brightly as before thereby maintaining the visual appearance of the numeral to be displayed.

Figure 7:
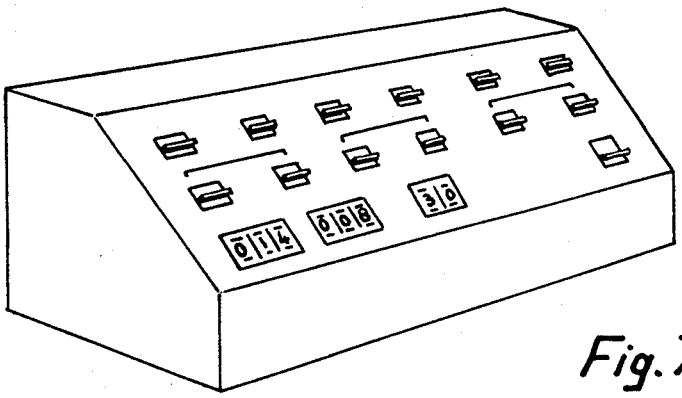
FIG. 7 illustrates in a perspective view a control unit for controlling a display such as shown in FIG. 1 when modified for use with basketball.
Figure 8:
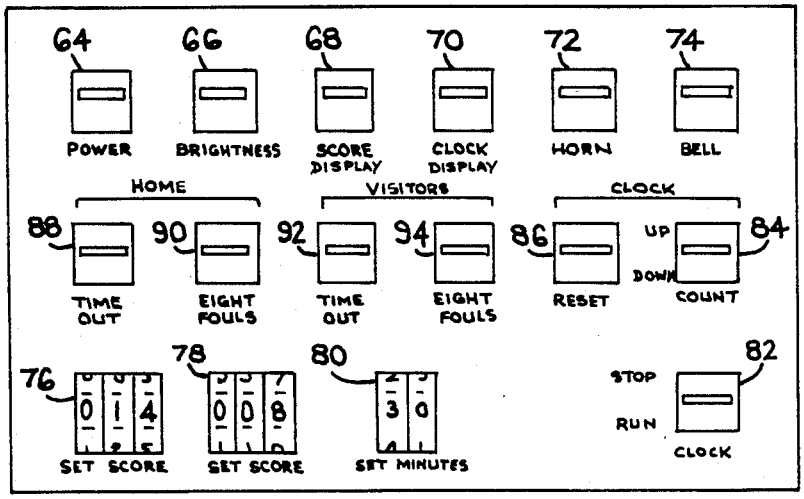
FIG. 8 is a view of the front panel of the control unit of FIG. 7 and shows the various controls which are available for altering the information displayed in the display unit of FIG. 1.

FIGS. 7 and 8 illustrate a control unit which can be used in conjunction with a board such as shown in FIG. 1. The control unit may derive its power from the electricity supply main via appropriate transformer and rectifying circuits (not shown) or from rechargeable cells such as motor car batteries (again not shown). It is a particular advantage of the present invention that although relatively high currents are required to maintain the illumination of the light emitting diodes, the voltage required even for a chain of eleven such diodes in series, is a relatively small one, only being a matter of a few volts, so that all the power requirements for a scoreboard of this nature can be obtained from a rechargeable twelve volt battery or two connected in series to provide twenty-four volts if required. The result is that the unit can be rendered totally portable and can be used out of doors quite safely.

If used indoors, a rechargeable battery can still be incorporated to advantage in view of the relatively high currents which are required if the display is used to its full, thus reducing the demands on the transformer and rectifying circuits which can be reduced considerably to provide simply a trickle charge into the rechargeable cell of some two or three amps at an appropriate voltage so as to recharge the battery between uses and maintain the battery in a fully charged state.

The controlling panel layout is shown in FIG. 8 and includes switches as follows:

At 64 an on/off switch for power to the unit as a whole.

At 66 a two-position switch for controlling the brightness of the display by controlling the bus-bar voltage.

At 68 an on/off switch for controlling the illumination to the score displays at 16 and 18.

At 70 an on/off switch for controlling the illumination of the time display at 13 in FIG. 1.

Further switches at 72 and 74 control the horn and bell if provided.

In the bottom left-hand corner are two rotary digital switches denoted by reference numerals 76 and 78 by which the two numerical values of the home and visitors scores can be entered in the display.

Each digital switch includes two or three rotatable elements containing around its external circular periphery a series of numbers in the range zero to nine and each position is denoted by a click stop or the like in which the number appearing in the window at the front of the panel will then correspond to the number in the display by appropriate decoding between the output from the switch and the control signals along the connections from the driving circuits on boards 38 to the appropriate printed circuit boards such as 26.

Approximately in the center of the lower part of the front panel of the control unit is a further rotary digital switch 80 which includes a number of rotary elements each having a series of numbers in the range zero to nine arranged around its circular periphery so that the different numbers can be introduced into the window display at 80 by appropriate rotation. The switch includes associated circuitry for producing electrical control signals which when decoded produce electrical signals for the appropriate control board such as 38 for producing appropriate control signals to cause illumination of the appropriate straight line segments of the bisected parallelogram rays of light emitting diodes to produce an appropriately illuminated numerical display and the position such as 13 in FIG. 1.

A further switch 82 is provided having two positions in which the clock circuit can be arranged to stop or run. In the stop mode, the time display in the display panel will be under the exclusive control of the switch 80 and when set to run the clock pulses will automatically increase or decrease the number which has been set by the digital switch 80 depending on the position of a further switch 84 which is a two position switch in one position of which the clock pulses will increase and in the other position of which they will decrease the numerical value set by the switch 80.

A further switch 86 is provided for reseting the numerical display value of the time to the last set value in the switch 80 whenever the switch is depressed.

When used for basketball, the display must indicate whether a time out applies or whether eight fouls have been registered and appropriate switches at 88, 90, 92 and 94 are provided to this end.

Where current limiting resistors are included in each line of light emitting diodes such as 52, 54, the value of each such resistor is selected in accordance with the number of L.E.D.'s.

I claim:

1. A scoreboard device for displaying numerical information comprising:

a rear support panel;

a front cover of colored transparent sheet material;

a surrounding frame for supporting said transparent sheet material relative to said rear support panel and forming a shallow box;

a plurality of replaceable printed circuit boards removably mounted within said shallow box, each said circuit board having mounted thereon a plurality of similarly appearing light emitting diodes arranged in the form of a bisected parallelogram configured so that different combinations of straight line sections of said bisected parallelogram correspond to numerals in the range of zero to nine;

a power supply unit connected to the display device, said power supply unit comprising a control unit having switching devices so that there is one said switching device for each said printed circuit board, each said switching device connected in a circuit with said light emitting diodes of different said sections, each said switching device being selectively operable to cause different combinations of said sections to be selectively supplied with current; said light emitting diodes making up each straight line section of said bisected parallelogram being arranged in two adjacent, spatially parallel rows, said two rows of each section being electrically connected in parallel for redundancy; each said row of each said section being supplied with current through its corresponding said control switch in its selected position simultaneously with but independently of the supply of current to the other said row; said plurality of light emitting diodes in each said row being electrically connected in series with one another.

2. A scoreboard device according to claim 1, wherein said transparent sheet material is removable by sliding same from said surrounding frame to provide direct access to said printed circuit board.

3. A scoreboard device according to claim 1, comprising a display unit which includes at least one array of said printed circuit boards for displaying numerals depicted by said light emitting diodes which are controlled by electrical signals derived from a clock generator to produce an increasing or decreasing numerical value with time.

4. A scoreboard device according to claim 1, wherein said switching devices are in said control unit, said switching devices comprising rotary switches each of which contains a plurality of rotatable elements, each rotatable element being provided around its periphery with the numbers zero to nine, said members being selectively viewable through a window provided in said control unit, each said rotatable element being rotatable through a series of click stop positions that change the selected viewable said number, the number appearing in said window corresponding to the number which is depicted by said light emitting diodes.

5. A scoreboard device according to claim 4, wherein said control unit comprises a clock generator for producing accurate clock pulses and means provided for decoding said pulses to provide either an increasing or decreasing digital signal to said printed circuit boards for display by said light emitting diodes as an ascending or descending numerical value corresponding to time.

6. A scoreboard device according to claim 5, wherein said control device comprises a reset device for resetting said numerical value to zero or to a preset number.

7. A scoreboard device according to claim 5, wherein said control device includes a switch for reducing the power available to said light emitting diodes so as to control their brightness.

8. A scoreboard according to claim 5, wherein said control unit include means for switching on or off said numerical value corresponding to time as displayed and further means for switching on and off other displayed information on the scoreboard.

9. A scoreboard device according to claim 1, wherein said control unit comprises at least one audible alarm and control switches for each said audible alarm.

10. A scoreboard device having for the display of numerical information, a device comprising: a replaceable printed circuit board for each displayed numeral removably mounted in the scoreboard; each said printed circuit board having for indicating a number seven straight line segments arranged in the form of a squared figure 8; each essentially vertical segment comprising an inner and an outer element lying side-by-side which are electrically connected in parallel for redundancy, each said element comprising a plurality of light emitting diodes of similar appearance when lit, the number of said light emitting diodes in said outer element of said side-by-side elements in each said essentially vertical segment comprising at least one more light emitting diode than the number of light emitting diodes in said inner element, said inner element also including current limiting resistor means so that the current flowing through said diodes is essentially the same in each element and each essentially horizontal segment comprising an upper and lower element lying side-by-side which are electrically connected in parallel for redundancy, each said element comprising a plurality of light emitting diodes of approximately the same brightness when lit, the number of diodes in each element being equal.

11. A scoreboard device in accordance with claim 10, wherein said outer element comprises eleven light emitting diodes and said inner element comprises nine said light emitting diodes.

12. A scoreboard device in accordance with claim 10, wherein six of said segments define the periphery of said figure 8 and in each of four essentially vertical segments of said six segments the outer elements comprise at least one more light emitting diode than said inner elements.

13. A scoreboard device in accordance with claim 12, wherein said three of seven segments are essentially horizontal and in said essentially horizontal segments said two elements comprise an equal number of light emitting diodes.

14. A scorebord device in accordance with claim 10, comprising a circuit board containing said elements, said circuit boards being independently removable from and replaceable in the display device.

15. A scoreboard device in accordance with claim 10, comprising a front cover of transparent sheet material and means for supporting said front cover in front of said segments so that it is selectively slideable in either of two horizontal directions to facilitate removal and replacement of said elements.

16. A scoreboard device for displaying numerical information, comprising:

a plurality of printed circuit boards, each said printed circuit board being arranged in the scoreboard to be readily removable and replaceable with another like board and having mounted thereon, in each of seven distinct segments, physically adjacent parallel sets of light emitting diodes, each of said sets of light emitting diodes having a substantially identical appearance when lit;

each said set of each said seven segments of light emitting diodes being arranged in a straight line and all of said light emitting diodes in each said set being connected electrically in series;

said physically parallel sets in each of said seven segments of said printed circuit board being connected electrically in parallel so that if one of said sets is extinguished the other said set in said physically parallel sets continues to emit light and illuminate said segment; and at least one of said sets in at least one segment of said seven segments having less said light emitting diodes than the other said set of said at least one segment, said set having less said light emitting diodes having current limiting resistor means so that the current flowing through said light emitting diodes is essentially equal for each said set.

17. A scoreboard device in accordance with claim 15, wherein said seven distinct segments of said physically parallel sets which are arranged on printed circuit board in a square figure 8 configuration.

18. A scoreboard device in accordance with claim 16, wherein the outer set of each essentially vertical distinct segment has more light emitting diodes than the inner set of each said segment.

19. A scoreboard device in accordance with claim 1, in which:

said plurality of light emitting diodes are arranged in the form of a bisected parallelogram.

20. A scoreboard device for displaying numerical information, comprising:

a rear support panel;

a frame surrounding and extending forward of said rear support panel whereby a shallow box is formed;

front channel members attached to said frame on a side opposite said rear support panel such that at least two opposing channel members are removeably attached to said frame;

means for attaching said opposing channel members;

a slidably removable front cover of colored transparent material, said front cover held in place by said channel members;

a plurality of indicator lights for indicating pertinent event information;

a plurality of replaceable printed circuit boards removably mounted in said shallow box, each said circuit board having mounted thereon a plurality of light emitting diodes arranged in seven segments configured as a bisected parallelogram wherein different combinations of straight line segments of said bisected parallelogram correspond to numbers in the range of zero to nine, said light emitting diodes being similar in appearance when lit;

a power supply unit connected to the scoreboard device, said power supply unit comprising a control unit having rotary switching devices such that there is one said rotary switching device for each said printed circuit board and other switching deivces to control other display elements of the scoreboard device; and wherein said light emitting diodes making up each straight line segment of said bisected parallelograms are arranged in two adjacent, spatially parallel rows, said two rows of each section being electrically connected in parallel so that if one of said rows is extinguished the other said row in said parallel rows continues to emit light and illuminate said segment and said light emitting diodes in each said row being electronically connected in series, one row in at least one segment of said seven segments having less light emitting diodes than the other row of said one segment, said one row having current limiting resistor means so that the current flowing through said light emitting diodes of said one row is essentially equal for each said row.

21. A scoreboard device as claimed in claim 20 wherein the outer row of said parallel rows contains a greater number of said light emitting diodes than does the inner row of the four vertical segments of said seven segments and the upper and lower rows to the three horizontal segments of said seven segments contain the same number of said light emitting diodes.

22. A scoreboard device as claimed in claim 20 wherein the outer row of said parallel rows of the six perimeter segments of said seven segments has at least the same number of said light emitting diodes as the inner row and the upper and lower rows of the segment bisecting said parallelogram of said permimeter segments have an equal number of light emitting diodes.

23. A scoreboard device as claimed in claim 20 wherein the inner and outer rows of said parallel rows of the four vertical segments of said seven segments have an equal number of light emitting diodes; the outer row of the top and bottom horizontal segments of said seven segments of said bisected parallelogram has a greater number of said light emitting diodes than does the inner row; and the rows of the segment bisecting said bisected parallelogram have an equal number of said light emitting diodes.

* * * * *